US005320034A

United States Patent [19]

Eccleston

[11] Patent Number: 5,320,034

[45] Date of Patent: Jun. 14, 1994

[54] METHOD AND APPARATUS FOR INCREASING SURFACE WITHIN WOOD CHIPS

[75] Inventor: John Eccleston, Carvel, Canada

[73] Assignee: Kvaerner Hymac, Inc., Canada

[21] Appl. No.: 106,778

[22] Filed: Aug. 16, 1993

Related U.S. Application Data

[63] Continuation of Ser. No. 829,523, Jan. 31, 1992, abandoned, which is a continuation of Ser. No. 579,683, Sep. 10, 1990, abandoned.

[30] Foreign Application Priority Data

Sep. 19, 1989 [CA] Canada ..... 612010

[51] Int. Cl.[5] ..... B30B 13/00; B30B 3/00

[52] U.S. Cl. ..... 100/35; 100/145

[58] Field of Search ..... 100/35, 37, 117, 126–129, 100/145–150; 366/76, 83

[56] References Cited

U.S. PATENT DOCUMENTS

| | | | |
|---|---|---|---|
| 604,348 | 5/1898 | Bussells | 100/127 X |
| 675,179 | 5/1901 | Wacker | 100/127 X |
| 687,909 | 12/1901 | Wacker | 100/117 X |
| 2,943,012 | 6/1960 | Dunning et al. . | |
| 2,975,096 | 3/1961 | Ginaven et al. . | |
| 3,092,338 | 6/1963 | Reinhall | 100/117 X |
| 3,470,815 | 10/1969 | Jung | 100/117 X |
| 4,121,967 | 10/1978 | Reinhall | 100/117 X |
| 4,260,488 | 4/1981 | Condolios | 100/117 X |
| 4,475,452 | 10/1984 | Koch et al. . | |
| 4,718,337 | 1/1988 | Wiederkehr | 100/117 X |

FOREIGN PATENT DOCUMENTS

| | | | |
|---|---|---|---|
| 497689 | 8/1928 | Fed. Rep. of Germany | 100/117 |
| 566267 | 12/1932 | Fed. Rep. of Germany | 100/127 |
| 2258259 | 8/1975 | France | 100/117 |
| 63-299890 | 12/1988 | Japan | 100/117 |
| 1021634 | 6/1983 | U.S.S.R. | 100/117 |
| 1475806 | 4/1989 | U.S.S.R. | 100/117 |

*Primary Examiner*—Stephen F. Gerrity

[57] ABSTRACT

A method of controlling the maceration of wood chips in a plug screw feeder having an inlet and an outlet, a compression device between said inlet and outlet, a variable speed screw disposed in the compression device, a force feed device connected to the plug screw feeder inlet, a variable speed force feed screw disposed in the force feed device, comprising the steps of introducing wood chips into the force feed drive and the plug screw feeder controlling the speed of the variable speed screw in the plug screw feeder, controlling the speed of the force feed screw disposed in the force feed cylinder to obtain the desired degree of fiber dislocation in the wood chips.

2 Claims, 1 Drawing Sheet

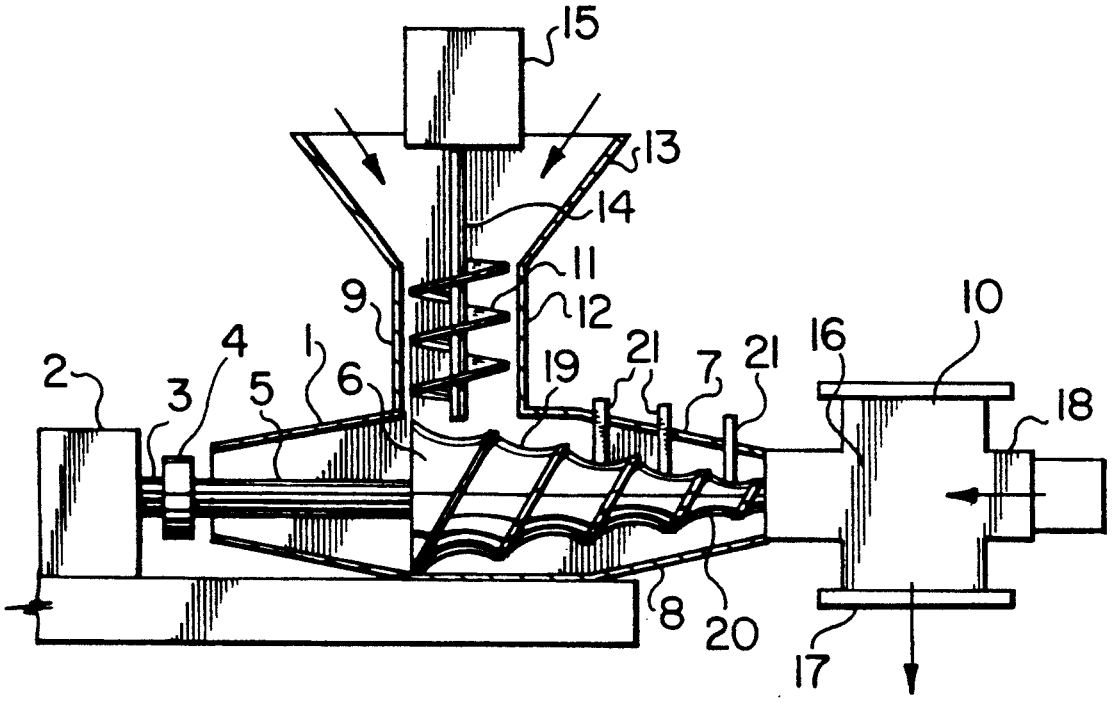
15
13
14
11
12
9
10
4
1
16
2
3
5
6
19
21
7
21
18
8
20
17

METHOD AND APPARATUS FOR INCREASING SURFACE WITHIN WOOD CHIPS

This application is a continuation of application Ser. No. 07/829,523, filed Jan. 31, 1992, now abandoned, which is a continuation of Ser. No. 07/579,683, filed Sep. 10, 1990, now abandoned.

BACKGROUND OF THE INVENTION

This invention relates to a method and apparatus for improving the performance of compression type feeders for bulk materials such as wood chips.

More particularly, this invention relates to a method and apparatus for controlling the degree of maceration of wood chips in a plug screw feeder comprised of a cylindrical or conical shell having an inlet and outlet, and a variable speed screw located in said cylindrical or conical shell, a variable speed force feed screw and cylinder attached to the inlet of the plug screw feeder, the improvement comprising controlling the speed of the variable speed screw of the plug screw feeder and controlling the speed of the variable speed screw of the inlet feed cylinder to obtain the desired degree of fiber dislocation in the wood chips.

The pulp and paper industry utilizes compression devices (plug screw feeders) to improve the liquor pick up in chemical impregnation of bulk materials such as wood chips or other fibrous materials when material is exposed to a liquor or expansion at discharge from the compression device by means of a liquor bath or shower. The plug screw feeders are based on the principle of a screw rotating inside a cylindrical or conical cage, where the volume available at the inlet of the screw is greater than the volume available at the discharge. The cage can be equipped with holes, usually conically drilled, or slots or bars arranged in such a fashion as to provide drainage of liquor squeezed from material being compressed. The cage is usually equipped with anti-rotation devices such as bars, pins or slots to prevent the compressed material from turning with the screw.

In the process of chemical impregnation of chips, it is common knowledge that improper penetration of chips with chemical can result in a lower quality product and a lower yield. In view of the inefficiency of the plug screw feeders a number of persons have resorted to shredding the chips before attempting impregnation of the chips in an effort to achieve a more uniform chemical application to individual fibres.

When chemical treatments are applied to chips in high yield processes prior to defibration, the resulting fibres exhibit low wet web strengths and increased energy is required to reach a given freeness. When defibration occurs prior to chemical treatment, wet web properties are enhanced and energy required to achieve a given freeness is reduced.

The use of a high compression device on chips prior to chemical treatment of chips results in retained wet web properties and lower energy consumption to a given freeness. It is believed that the high compression of chips results in fibre dislocations along the S1/S2 fibre wall, giving increased specific surface which results in improved pulp properties. Additionally, fractures and fissures occur in the chips which allows full penetration of the chips with chemicals.

Although high yield processes such as chemical thermal mechanical pulp (CTMP) reduce the amount of effluent containing BOD, COD and toxic products, primarily due to higher yield, particularly when compared to the sulfite process, the effluent from CTMP processes is nevertheless highly toxic, and many mills have difficulty in meeting their effluent permits. One of the most toxic effluent streams is the pressate, from the plug screw feeders. By using high compression ratio plug screw feeders, it is possible to extract a very concentrated effluent stream which can then be treated independently of the general effluent system.

The various uses of plug screw feeders involve a number of mechanisms for creating pressure between the chamber and the shaft bearing flights. The inner diameter of the chamber may be cylindrical, conical, or may contain restricted areas. All of these features together with variations in the diameter of the shaft or diameters of the flutes on the shaft can produce changes in the pressure exerted on the wood chips or other material being treated in the plug screw feeder. The chamber of the plug screw feeder may be comprised of bars, screens or be solid depending upon whether the plug screw-feeder is being used to drive off excess water or being used to refine wood chips or both remove excess fluid and refine. in various applications the pressure and throughput is controlled by the voids if any in the chamber, the restrictions in the chamber, the shaping of the shaft or flutes and the torque applied to the screw feeder. The applicant has found that in many applications improved efficiency and throughput of a plug screw feeder can be achieved by feeding wood chips or other materials under pressure into the plug screw-feeder.

Several companies have attempted to build high compression plug screw feeders with high performance but many problems have occurred. First of all, the true compression ratio was much less than the theoretical ratio and plugging of units occurred due to plug spinning.

The theoretical compression ratio of a plug screw feeder is the volume of the first enclosed pocket or flight spacing in the inlet zone, divided by the volume of the last enclosed pocket or flight spacing in the discharge zone. Reasons for the actual compression ratio not being equal to the theoretical are thought to be as follows:

1) Inadequate filling of the inlet zone.
2) Back flow of the chips from the compression cone to the inlet area.

The above plus rotation of the chip plug results in an actual capacity being much lower than the theoretical.

Wood chips being a non-homogeneous substance have a bulk packing density approximately ½ that of solid wood. For spruce, for example, the bulk density of chips is approximately 12 lbs/ft$^3$ (192 kg/m$^3$). Production tests show that a typical plug screw feeder will have 60% of its theoretical capacity when a packing density of 12 lbs/ft$^3$ (192 kg/m$^3$) is used in the calculation.

A number of attempts have been made to improve the filling and feeding of plug screw feeders. Various types of inlet chute designs have been tried, including the use of vibrators and rotating paddles and agitators. All of these devices, however, rely principally on gravity to fill the inlet zone of the screw.

In attempting to reduce the problem of back flow and increase transportation efficiency, anti-rotation devices similar to that described in U.S. Pat. No. 4,475,452 have been tried. Although these did improve the performance, their effect was marginal in that actual vs theoretical was improved by less than 10%.

Moreover, since the packing density is an uncontrolled variable affected by chip size classification and uniformity thereof, it is virtually impossible to predict or control the effective compression ratio in a given situation.

SUMMARY OF THE INVENTION

The compression device for bulk material such as wood chips of this invention overcomes the limitations of inadequate and/or unpredictable inlet filling associated with such compression devices now in use. The variable speed force feed screw to the inlet of the compression device works like a "supercharger" by forcing material into the inlet section of the compression device, thus providing an increased and uniform packing density in the inlet. The fully packed inlet also prevents back flow of chips from the compression cone. The full compression of the screw is then available to work on the material thus increasing the effective compression ratio.

One embodiment of the invention relates to a method of controlling the maceration of wood chips in a compression device having an inlet and an outlet, a variable speed screw disposed in the compression device, a force feed device connected to the inlet of the plug screw feeder, a variable speed force feed screw disposed in the force feed device, the method comprising the steps of introducing wood chips into the force feed drive and the plug screw feeder controlling the speed of the variable speed screw in the plug screw feeder and controlling the speed of the force feed screw disposed in the force feed cylinder to obtain the desired degree of fiber dislocation in the wood chips.

Another embodiment of the invention relates to a plug screw feeder for use in the maceration of wood chips to obtain a desired degree of dislocation of fibers in wood chips comprising a plug screw feeder having an inlet and an outlet, a variable speed screw disposed in the plug screw feeder, a force feed device connected to the plug screw feeder inlet, a variable speed force feed screw disposed in the force feed device, means for controlling the speed of rotation of the variable speed screw of the plug screw feeder and means for controlling the speed of rotation of the screw of the force feed device.

The force feed screw has a variable speed drive. By adjusting the torque applied to the force feed screw, the packing density can be affected, giving an ability to adjust the effective compression ratio of the compression feeder to meet the requirements of the process.

It has been observed that by increasing the torque on the force feed screw, the following will occur:

1) the power demand on the compression device increases;
2) the quantity of liquor extracted increases;
3) the dryness of material exiting the compression device increases;
4) the degree of maceration of the material increases;
5) the quantity of impregnation liquor subsequently picked up in subsequent application of liquor by spraying or immersion increases.

BRIEF DESCRIPTION OF THE DRAWING

FIG. 1 is a schematic drawing of a plug screw feeder.

DESCRIPTION OF THE PREFERRED EMBODIMENTS

As seen in FIG. 1, the plug screw feeder 1 is comprised of a power source 2, power drive shaft 3, transmission 4, screw drive shaft 5 and screw 6 which are all interconnected. The screw 6 is enclosed within compression cone or cylinder 7. Compression cone or cylinder 7 includes screen plates 8 through which liquid is drained during compression and thickening of the bulk material. The plug screw feeder 1 has an inlet housing 9 and an outlet housing 10. The inlet housing is comprised of a force feed screw 11 inside force feed cylinder 12. Force feed cylinder 12 rests below surge bin 13. Force feed screw 11 is attached by drive shaft 14 to variable feed screw power source 15. The outlet housing 10 includes discharge chamber 16, discharge outlet 17 and fluid or blowback damper 18. The plug screw 6 is comprised of a series of flights or pockets commencing at 19 proximate the inlet housing 9 and decreasing in volume until the flight or pocket 20 of least volume proximate the outlet housing 10. A series of antirotation pins 21 are mounted in the wall of compression cone or cylinder 7.

In operation the compressible material is loaded in the surge bin 13 and the force feed cylinder 12. The power source 2 is activated and the plug screw 1 begins rotating and compressing the compressible material in compression cone or cylinder 7. The variable feed screw power source is turned on and force feed screw 11 continues to force the compressible material into the largest volume flight pocket 19. By controlling power source 2 of screw plug 1 and variable feed screw power source 15 the compression of the compressible feed to the large volume flight 19 and subsequent flights of the plug screw feeder 1 may be controlled.

We claim:

1. A plug screw feeder (1) for increasing fiber dislocation within wood chips consisting of:

an inlet housing (9) and an outlet housing (10), a variable speed plug screw (6) disposed in the plug screw feeder (1), a force feed cylinder (12) connected to the plug screw feeder inlet housing (9), a variable speed force feed screw (11) disposed in the force feed cylinder (12), a variable speed plug screw power source (2) connected to the variable speed plug screw (6), a variable feed screw power source (15) connected to the force feed screw (11), control means to control the variable speed force feed screw (11) and the variable speed plug screw (6), said controlling means controlling the speed of the rotation of the variable speed plug screw (6) in the plug screw feeder (1) and the speed of the rotation of the variable speed force feed screw (11) disposed in the force feed cylinder (12) for increasing the real compression ratio in the plug screw feeder (1) towards the theoretical compression ratio of the plug screw feeder.

2. A method of controlling the fiber dislocation in wood chips in a plug screw feeder (1) said plug screw feeder comprising an inlet housing (9) and an outlet housing (10), a variable speed plug screw (6) disposed in the plug screw feeder (1), a force feed cylinder (12) connected to the plug screw feeder inlet housing (9), a variable speed force feed screw (11) disposed in the force feed cylinder (12), control means to control the variable speed force feed screw (11) and the variable speed plug screw (6), the method comprising the steps of introducing wood chips into the force feed cylinder

(12) connected to the plug screw feeder inlet housing (9), and controlling the speed of the variable speed plug screw (6) in the plug screw feeder (1) and the speed of the variable speed force feed screw (11) disposed in the force feed cylinder (12) by use of the control means to increase the real compression ratio in the plug screw feeder (1) towards the theoretical compression ratio of the plug screw feeder as the chips are fed through the force feed cylinder to and then through the plug screw feeder.

* * * * *